US007228842B2

(12) United States Patent
Kato

(10) Patent No.: US 7,228,842 B2
(45) Date of Patent: Jun. 12, 2007

(54) ELECTRONIC THROTTLE CONTROL APPARATUS FOR INTERNAL COMBUSTION ENGINE

(75) Inventor: Yasuhiro Kato, Chita-gun (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/370,090

(22) Filed: Mar. 8, 2006

(65) Prior Publication Data

US 2006/0207552 A1 Sep. 21, 2006

(30) Foreign Application Priority Data

Mar. 16, 2005 (JP) ..... 2005-074262

(51) Int. Cl.
*F02D 11/10* (2006.01)

(52) U.S. Cl. ..... 123/396; 123/399

(58) Field of Classification Search ..... 123/361, 123/396, 399; 73/118.1; 701/110
See application file for complete search history.

(56) References Cited

U.S. PATENT DOCUMENTS 5,828,193 A * 10/1998 Furuta ..... 123/399
5,950,597 A * 9/1999 Kamio et al. ..... 123/399
6,636,783 B2 * 10/2003 Yasui et al. ..... 123/399
6,701,891 B2 * 3/2004 Niki et al. ..... 123/396
2002/0193935 A1 * 12/2002 Hashimoto et al. ..... 701/110

FOREIGN PATENT DOCUMENTS

JP 3562938 6/2004

* cited by examiner

*Primary Examiner*—T. M. Argenbright
(74) *Attorney, Agent, or Firm*—Nixon & Vanderhye P.C.

(57) ABSTRACT

An electric throttle control apparatus for an internal combustion engine includes a throttle motor that operates the throttle valve. A throttle control unit controls driving duty for operating the throttle motor. The throttle control unit determines a tapping operation for learning a full close position of the throttle valve to be completed when the accelerator position is at a substantially minimum position, the opening degree of the throttle valve is substantially constant in the vicinity of the full close position, and the driving duty for operating the throttle motor with respect to a close direction of the throttle valve becomes equal to or greater than a threshold. The throttle control unit restricts the driving duty to be equal to or less than a driving duty limiting value, thereby maintaining the throttle valve in the full close position, when the throttle control unit determines the completing condition to be satisfied.

15 Claims, 3 Drawing Sheets

| vb(V) | 6 | 8 | 10 | 12 | 14 | 16 |
|---|---|---|---|---|---|---|
| DUTYHCL(%) | -100 | -75 | -60 | -50 | -43 | -38 |

ELECTRONIC THROTTLE CONTROL APPARATUS FOR INTERNAL COMBUSTION ENGINE

CROSS REFERENCE TO RELATED APPLICATIONS

This application is based on and incorporates herein by reference Japanese Patent Application No. 2005-74262 filed on Mar. 16, 2005.

FIELD OF THE INVENTION

The present invention relates to an electronic throttle control apparatus for an internal combustion engine. More particularly, the present invention relates to an electronic throttle control apparatus controlling a driving duty for operating a throttle motor such that opening degree of a throttle valve coincides with target opening degree of the throttle valve in accordance with a driving condition, such as an accelerator position.

BACKGROUND OF THE INVENTION

According to JP-B2-3562938, an electronic throttle control apparatus is provided to a vehicle for controlling an internal combustion engine. In this throttle control apparatus, a throttle valve collides against a full close stopper immediately after turning an ignition switch ON, so that the throttle control apparatus learns a full close position as a reference position of the throttle valve in accordance with a detection signal of a throttle position sensor. Driving duty applied to the throttle motor, such as a DC motor is controlled using a PID algorithm, for example, such that actual opening degree of the throttle valve coincides with target opening degree of the throttle valve on the basis of the full close position, as the reference position, in an engine operating condition. The target opening degree of the throttle valve is set on the basis of an accelerator position, for example. The actual opening degree of the throttle valve is detected using the throttle position sensor.

In this structure, an error may arise in a learning operation of the full close position, which corresponds to the position of the full close stopper, due to an error arising in detection of the throttle opening sensor. Accordingly, when the target opening degree is set at the full close position, the learning value of the full close position may be displaced to the closing side with respect to the actual point of the full close position. When the learning value is displaced to the closing side, the driving operation of the throttle valve to the closing side may be continued by the PID control after the throttle valve collides against the full close stopper in the full close position. In this condition, deviation between the actual opening degree of the throttle valve and the target opening degree of the throttle valve may not decrease. As a result, the driving duty for operating the throttle motor may immediately increase to the maximum driving duty such as −100%, and excessive current may flow through a winding of the throttle motor. When this condition continues, the winding of the throttle motor may cause a failure such as burnout.

In view of the above problem, it may be determined that the throttle motor is in a fail condition when the maximum driving duty applied to the throttle motor is maintained for a predetermined period. In this fail condition, the operation mode may be switched to a failsafe mode, in which electricity supplied to the throttle motor may be terminated, and the throttle valve may be mechanically operated in conjunction with the operation of the accelerator pedal. In JP-B2-3562938, the learning value of the full close position is biased during the engine operation, so that the throttle valve may be controlled such that the throttle valve does to collide against the full close stopper, which corresponds to the actual point of the full close position. In this operation, driving the throttle valve in the vicinity of the full close position can be prohibited. Alternatively, the learning value of the full close position may be corrected every time in a condition, in which the throttle valve makes contact with the full close stopper, during the engine operation.

However, in recent years, enhancement in fuel efficiency of the engine and reduction in emission are progressively required. Accordingly, it is required to enhance a control performance of the throttle valve in the vicinity of the full close position for reducing idling engine speed when the engine rotation speed is extremely low. However, it is difficult to satisfy these requirement using the above structures and operations. Specifically, in JP-B2-3562938, the throttle valve is controlled such that the throttle valve does to collide against the full close stopper when the learning value of the full close position is displaced. Accordingly, it is difficult to control the throttle valve in the vicinity of the full close position.

According to the above operation, the operation mode may be switched to the failsafe mode when the maximum driving duty continues for a predetermined period. However, when the throttle valve is controlled in the vicinity of the full close condition for a long period, errors may arise in the learning operation of the full close position and in detection of the throttle opening sensor. Accordingly, the throttle valve may collide against the full close stopper due to these errors, and the throttle control apparatus may be determined to be in the fail condition. Consequently, in this operation, the throttle valve needs to be restricted from controlling in the vicinity of the full close position.

Furthermore, according to the above operation, the learning value of the full close position may be corrected every time in a condition, in which the throttle valve makes contact with the full close stopper, during the engine operation. However, even in this operation, the learning operation of the full close position may cause a slight error. In addition, an error may arise in detection of the throttle opening sensor. Accordingly, in this operation, the correcting operation of the full close position may be frequently repeated when the throttle valve is controlled in the vicinity of the full close condition for a long period. Accordingly, the full close condition may become unstable, consequently the control of the throttle valve also may become unstable.

SUMMARY OF THE INVENTION

In view of the foregoing and other problems, it is an object of the present invention to produce an electronic throttle control apparatus for an internal combustion engine, the control apparatus being capable of controlling a throttle in the vicinity of a full close position of the throttle.

According to one aspect of the present invention, an electric throttle control apparatus for an internal combustion engine includes a throttle valve, a throttle motor, and a throttle control unit. The throttle motor operates the throttle valve. The throttle control unit controls driving duty for operating the throttle motor such that an actual opening degree of the throttle valve coincides with a target opening degree of the throttle valve. The target opening degree is set in accordance with an accelerator position. The throttle control unit is adapted for performing a tapping operation to learn a full close position of the throttle valve. The throttle control unit determines that the tapping operation of the throttle valve is completed when the throttle control unit determines the following completing conditions to be satisfied. First, the accelerator position is at a substantially minimum position. Second, the opening degree of the throttle valve is substantially constant in the vicinity of the full close position of the throttle valve. Third, the driving duty for operating the throttle motor with respect to a close direction of the throttle valve becomes equal to or greater than a threshold. The throttle control unit restricts the driving duty with respect to the close direction to be equal to or less than a driving duty limiting value, thereby maintaining the throttle valve in the full close position, when the throttle control unit determines the completing condition to be satisfied.

A method, which is for controlling driving duty applied to a throttle motor operated using a throttle motor, includes the following steps. A tapping operation is performed to learn a full close position of the throttle valve. The tapping operation is determined to be completed when the following completing conditions are satisfied. First, an accelerator position is at a substantially minimum position. Second, an opening degree of the throttle valve is substantially constant in the vicinity of the full close position of the throttle valve. Third, the driving duty for operating the throttle motor with respect to a close direction of the throttle valve becomes equal to or greater than a threshold. The method further includes the following step. The throttle valve is maintained in the full close position by restricting the driving duty to be equal to or less than a driving duty limiting value, when the completing condition is satisfied.

Thus, the driving duty of the throttle motor is restricted in the tapping operation, so that impact, which arises when the throttle valve 12 collides against the full close position, can be reduced.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

Embodiment

Figure 1:
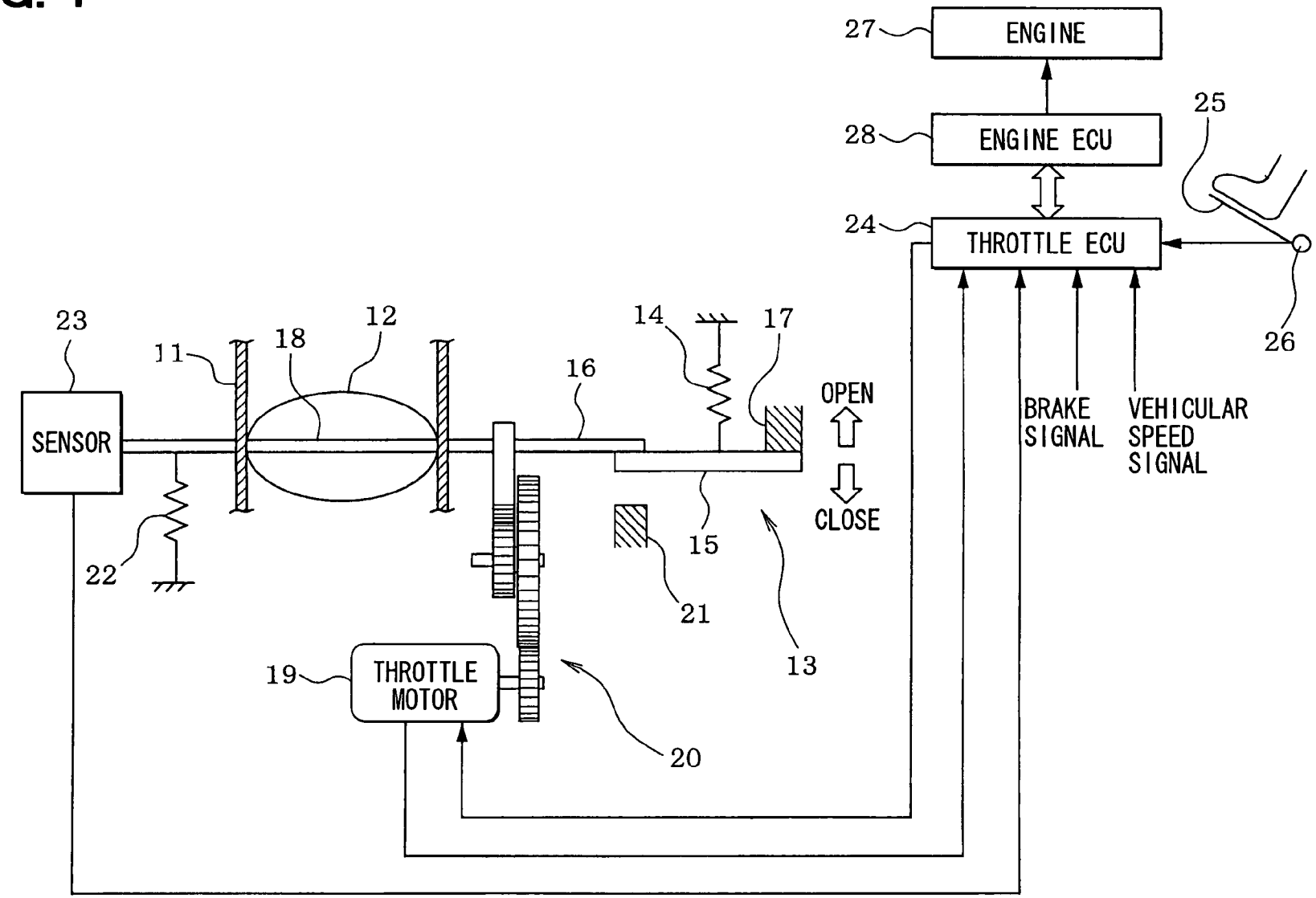
FIG. 1 is a schematic view showing a system of a throttle control apparatus, according to an embodiment of the present invention.

As shown in FIG. 1, a throttle valve 12 is provided to an intake pipe 11. The throttle valve 12 is biased using an opener device 13 in an open direction in which the throttle valve opens the intake pipe 11. The opener device 13 includes an opener lever 15, which is biased in the open direction using an opener spring 14. The opener lever 15 hooks to a valve lever 16, thereby biasing the throttle valve 12 in the open direction. The opener lever 15 is restricted in a rotatable angle thereof with respect to the open direction using an opener stopper 17. The opener lever 15 is restricted in the rotatable angle thereof with respect to a close direction, in which the throttle valve 12 closes the intake pipe 11, at a full close position using a full close stopper 21. The valve lever 16 rotates integrally with a rotation shaft 18 of the throttle valve 12. The throttle valve 12 rotates integrally with the valve lever 16 and the rotation shaft 18 in a rotation range defined between the opener stopper 17 and the full close stopper 21 while maintaining a condition, in which the valve lever 16 hooks to the opener lever 15.

Rotation of a throttle motor 19 is transmitted to the rotation shaft 18 of the throttle valve 12 via a reduction gear device 20, thereby rotating the throttle valve 12. The throttle motor 19 is constructed of a DC motor, which is capable of reversing the rotating direction thereof by reversing a direction of electricity supplied through a winding of the throttle motor 19. Electricity supplied to the winding of the throttle motor 19 is controlled by operating driving duty applied to the throttle motor 19, so that torque generated using the throttle motor 19 and rotation speed of the throttle valve 12 are controlled. The rotation shaft 18 of the throttle valve 12 is applied with biasing force in the close direction using the return spring 22. The biasing force generated using the return spring 22 in the close direction is set to be less than biasing force generated using the opener spring 14 in the open direction. Therefore, the throttle motor 19 needs to be driven in the close direction against the biasing force of the opener spring 14, which applies torque in the open direction, for rotating the throttle valve 12 to the full close position, using the driving force of the throttle motor 19, which applies torque in the close direction. The full close position of the throttle valve 12 is defined by the position, in which the opener lever 15 taps on the full close stopper 21. The throttle valve 12 rotates integrally with the valve lever 16 and the rotation shaft 18 within the rotation range between the opener stopper 17 and the full close stopper 21, while maintaining the condition, in which the valve lever 16 hooks to the opener lever 15. When the throttle valve 12 rotates in the open direction beyond the position of the opener stopper 17, the valve lever 16 is spaced from the opener lever 15. As the throttle valve 12 is further opened, the valve lever 16 further rotates in the open direction while maintaining a condition, in which the opener lever 15 is maintained at the opener stopper 17.

Opening degree (throttle opening) of the throttle valve 12 is detected using a throttle opening sensor (throttle sensor) 23 that outputs a signal to a throttle ECU (electronic control unit, throttle control unit) 24. The throttle ECU 24 inputs a signal output from an accelerator position sensor 26, which detects an accelerator position ap, for which an accelerator pedal 25 is stepped. The throttle ECU 24 further inputs signals indicating operating conditions of the engine, such as a brake signal and vehicular speed signal. In this structure, the throttle ECU 24 sets a target throttle opening in accordance with the accelerator position ap, which is detected using the accelerator sensor 26, and the operating condition of the engine, while the engine is operated. The throttle ECU 24 controls driving duty of the throttle motor 19 using a PID algorithm, for example, such that an actual opening degree (actual throttle opening) of the throttle valve 12 coincides with the target throttle opening. The actual throttle opening corresponds to a detection signal of the throttle sensor 23. The throttle ECU 24 controls the throttle motor 19 in the close direction when an ignition switch is turned ON such that the throttle valve 12 taps onto the full close stopper 21, which corresponds to the position of the full close position. Thus, the throttle ECU 24 learns the full close position as a reference position in accordance with the detection signal of the throttle sensor 23. When the throttle ECU 24 learns the reference position in a reference position learning operation within a reference position learning period, a driving duty limiting value DUTYLRN is set with respect to the close direction for protecting the throttle system from causing a failure. Thus, the driving duty of the throttle motor 19 is restricted in the reference position learning operation, so that impact, which arises when the throttle valve 12 collides against the full close stopper 21 in the full close position, can be reduced.

The throttle ECU 24 connects with an engine ECU 28 that controls engine apparatuses such as a fuel injection apparatus and an ignition apparatus of the internal combustion engine 27. The throttle ECU 24 and the engine ECU 28 transmit signal to each other, thereby performing a throttle control in accordance with the accelerator position ap and the operating condition of the engine. The operations of both the engine ECU 28 and the throttle ECU 24 may be performed using one ECU, i.e., one microprocessor.

An error may arise in the reference position learning operation. That is, an error may arise in the learning operation of the full close position, which corresponds to the position of the full close stopper 21, due to an error in a detecting operation using the throttle sensor 23. Accordingly, when the target throttle opening is set in the full close position, a learning value, which is obtained in the learning operation of the full close position, may be displaced to the closing side with respect to the actual point of the full close position. When the learning value is displaced to the closing side, the throttle valve 12 may be excessively rotated to the closing side by the control using the PID algorithm, after the throttle valve 12 collides against the full close stopper 21 in the full close position. In this condition, deviation between the actual throttle opening and the target throttle opening may not decrease, even rotation of the throttle valve 12 in the close direction is continued after the throttle valve 12 collides against the full close stopper 21. As a result, the driving duty for operating the throttle motor 19 may immediately increase to the maximum value (maximum driving duty) of the driving duty such as −100%, and excessive electricity may flow through the winding of the throttle motor 19. When this excessive energizing condition continues, the winding of the throttle motor 19 may cause burnout.

Figures 2, 4:
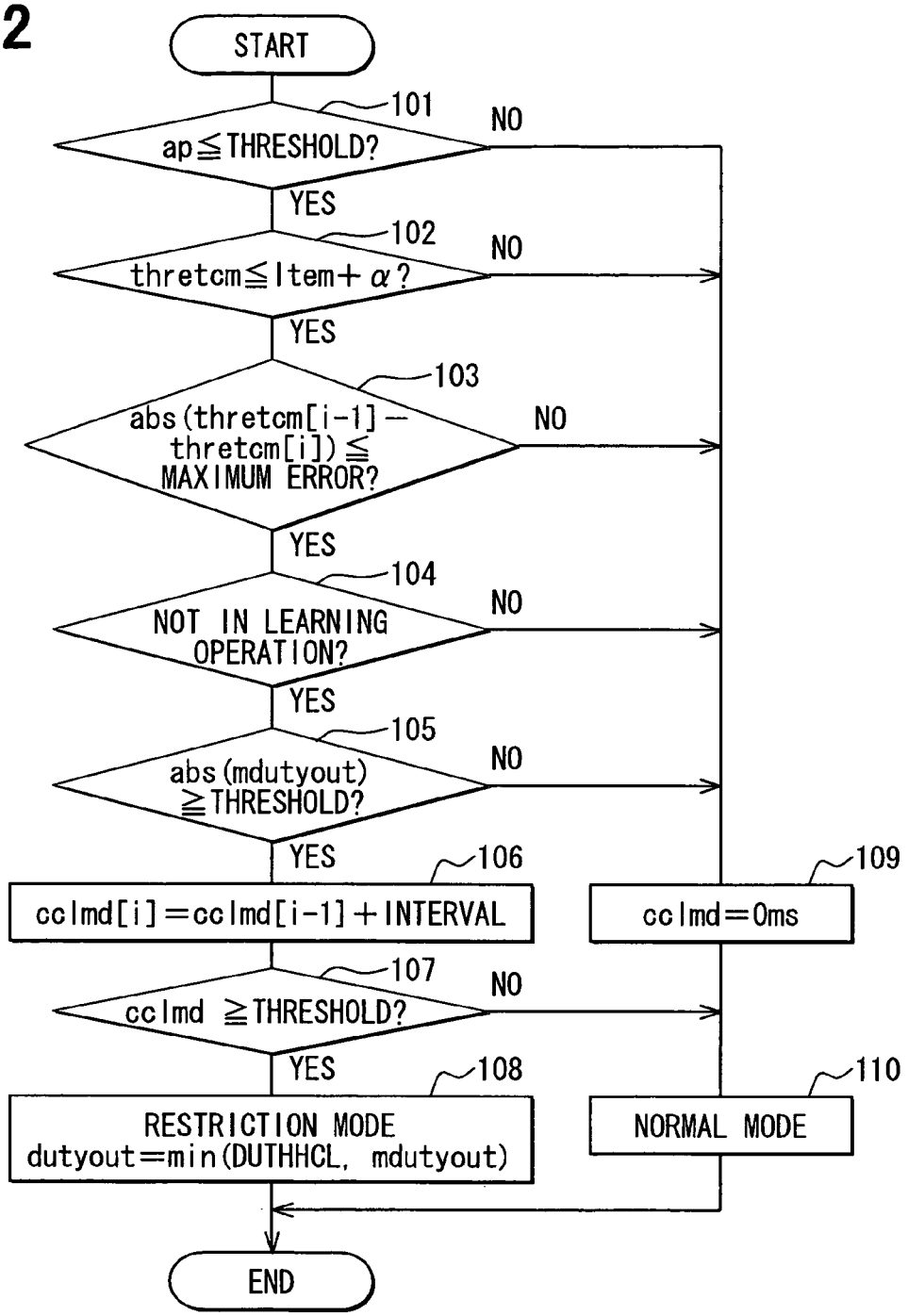
FIG. 2 is a flowchart showing a control routine of a throttle motor of the throttle control apparatus, according to the embodiment.
FIG. 4 is a table showing an example of a relationship between battery voltage and a limiting value of driving duty applied to the throttle motor, according to the embodiment.

In view of this problem, in this embodiment, the throttle ECU 24 executes a throttle motor control routine shown in FIG. 2. Summarizing this control routine shown in FIG. 2, it is evaluated whether the throttle valve 12 is maintained rotating in the close direction beyond the full close position, in a condition where the following two conditions are satisfied. First, it is determined that the accelerator position ap is in the minimum position, in which the accelerator pedal is not stepped, for example, and the actual throttle opening detected using the throttle sensor 23 is substantially constant in the vicinity of the full close position. Second, the driving duty, which is applied to the throttle motor 19 with respect to the close direction of the throttle valve 12, exceeds a threshold in the negative direction. When the two conditions are satisfied, it is determined that the throttle valve 12 is in the full close position, and is continuously driven in the close direction. Therefore, it is determined that the tapping operation of the throttle valve 12 in the full close position is completed. When this condition, in which the throttle valve 12 is continuously driven after completing the tapping operation, is maintained for a predetermined period, the closing duty is restricted within a predetermined limiting range, in which the winding of the throttle motor 19 may not cause a failure such as burnout.

The predetermined time is set within a maximum allowable period (100% duty maximum allowable period), in which 100% of the driving duty (100% duty) can be continuously applied to the throttle motor 19. The predetermined limiting range is defined to be equal to or less than a driving duty limiting value. The driving duty limiting value is the maximum value, for which the closing duty can be applied to the throttle motor 19 without causing a failure such burnout. Thus, the throttle ECU 24 maintains the throttle valve 12 in the full close position while reducing tapping torque applied to the throttle valve 12.

Next, the operation of the throttle motor control routine is specifically described in reference to FIG. 2. This control routine is executed as a throttle control unit at a regular interval such as 8 ms, while the engine is operated. In step 101, the throttle ECU 24 evaluates whether the accelerator position ap is in the full close position, in accordance with an actual value (actual accelerator position) of the accelerator position ap, which is detected using the accelerator sensor 26. In the full close position, an idling operation is requested. More specifically, the throttle ECU 24 evaluates whether the actual accelerator position ap is equal to or less than a threshold for evaluating whether the accelerator position ap is in the full close position. When it is determined that the accelerator position ap is not in the full close position, the routine proceeds to step 109, in which an execution counter cclmd is reset to be zero. Subsequently, in step 110, the throttle ECU 24 sets a throttle control mode at a normal mode, in which the driving duty dutyout of the throttle motor 19 is not restricted. Thus, the routine is terminated.

When it is determined that the accelerator position ap is in the full close position in step 101, the routine proceeds to step 102, in which the actual throttle opening thretcm, which is detected using the throttle position sensor 23, is in the vicinity of the full close position. More specifically, the throttle ECU 24 evaluates whether the actual throttle opening thretcm is equal to or less than a summation of a learning value (full close learning value) Itam of the full close position and a predetermined value $\alpha$. That is, the throttle ECU 24 evaluates whether the following relationship is satisfied: $\text{thretcm} \leqq \text{Itam}+\alpha$. The predetermined value $\alpha$may be set at 2 deg, for example.

In this step 102, when the actual throttle opening thretcm is not in the vicinity of the full close learning value Itam, the routine proceeds to step 109, in which the execution counter cclmd is reset, and the throttle control mode is set at the normal mode. Subsequently, the routine is terminated.

When the throttle ECU 24 determines the actual throttle opening thretcm to be in the vicinity of the full close learning value Itam, i.e., full close position, the routine proceeds to step 103. In step 103, the throttle ECU 24 evaluates whether the actual throttle opening thretcm is maintained in a constant position. Specifically, the throttle ECU 24 evaluates whether the absolute value, which is between a previous detection value thretcm[i−1] of the actual throttle opening and a present detection value thretcm [i] of the actual throttle opening, is equal to or less than a maximum detection error of the throttle opening sensor 23. The maximum detection error of the throttle opening sensor 23 is 0.5 deg, for example. When the throttle ECU 24 determines that the actual throttle opening thretcm is not maintained in a constant position, the throttle ECU 24 determines that the throttle valve 12 is not maintained in the full close position. In this case, the routine proceeds to step 109, in which the throttle ECU 24 resets the execution counter cclmd. In the subsequent step 110, the throttle ECU 24 sets the throttle control mode at the normal mode, so that the throttle ECU 24 terminates the routine.

By contrast, when the throttle ECU 24 determines that the actual throttle opening thretcm is maintained in a constant position in step 103, the routine proceeds to step 104, in which the throttle ECU 24 evaluates whether a learning operation (full close learning operation) of the full close position of the throttle valve 12 is being proceeded. When the full close learning operation is being proceeded, a negative determination is made in step 104, so that the routine proceeds to step 109, in which the throttle ECU 24 resets the execution counter cclmd. In the subsequent step 110, the throttle ECU 24 sets the throttle control mode at the normal mode, so that the throttle ECU 24 terminates the routine.

When the throttle ECU 24 determines that the full close learning operation is not being proceeded in step 104, a positive determination is made in step 104, so that the routine proceeds to step 105. In step 105, the throttle ECU 24 evaluates whether the absolute value of a required driving duty mdutyout of the throttle motor 19 is equal to or greater than a threshold such as 80%. The required driving duty mdutyout of the throttle motor 19 is set using a PID algorithm, for example, in accordance with the deviation between the actual throttle opening thretcm and a target throttle opening tangletv. When the absolute value of the required driving duty mdutyout is not equal to or greater than the threshold, the throttle ECU 24 determines that the throttle valve 12 is not still maintained in the full close position, so that the routine proceeds to step 109. In step 109, the execution counter cclmd is reset, and in the subsequent step 110, the throttle ECU 24 sets the throttle control mode at the normal mode, so that the throttle ECU 24 terminates the routine. In this case, the actual driving duty dutyout is directly set at the required driving duty mdutyout, before the throttle ECU 24 switches the normal mode to a restriction mode.

By contrast, in step 105, when the throttle ECU 24 determines that the absolute value of the required driving duty mdutyout is equal to or greater than the threshold, the throttle ECU 24 determines that the throttle valve 12 is maintained in the full close position, so that the routine proceeds to step 106. In step 106, the execution counter cclmd is incremented by the regular interval of the control routine such as 8 ms. Specifically, a present value of the execution counter cclmd[i] is incremented by the regular interval to be a subsequent value of the execution counter cclmd[i−1]. The execution counter cclmd is used for counting duration of the condition, in which the throttle valve 12 is maintained in the full close position. In the subsequent step 107, the throttle ECU 24 evaluates whether the execution counter cclmd is equal to or greater than a threshold. This threshold is set at a value within the range of the 100% duty maximum allowable period, such as 296 ms. Specifically, this threshold is set such that the throttle motor 19 may not cause a failure such as burnout of the winding even when the 100% duty is continuously applied to the throttle motor 19 for the duration of this threshold within the 100% duty maximum allowable period. When the throttle ECU 24 determines that the execution counter cclmd is not equal to or greater than the threshold, the routine proceeds to step 110, in which the throttle ECU 24 sets the throttle control mode at the normal mode, so that the throttle ECU 24 terminates the routine.

Subsequently, when the throttle ECU 24 determines that the execution counter cclmd becomes equal to or greater than the threshold in step 107, the routine proceeds to step 108, in which the throttle ECU 24 sets the throttle control mode at the restriction mode. Specifically, in the restriction mode, the throttle ECU 24 restricts the required driving duty mdutyout on the closing side to be equal to or less than a driving duty limiting value DUTYHCL, thereby restricting the required driving duty mdutyout within the range, in which the throttle motor 19 does not cause a failure such as burnout of the winding. In this restricting mode, the throttle ECU 24 compares the driving duty limiting value DUTYHCL with the present required driving duty mdutyout, thereby selecting one of the driving duty limiting value DUTYHCL and present required driving duty mdutyout, which has the absolute value less than the absolute value of the other one. The throttle ECU 24 sets the actual driving duty dutyout at the one of the driving duty limiting value DUTYHCL and the present required driving duty mdutyout, which has the absolute value thereof less than that of the other one. The throttle ECU 24 applies the actual driving duty dutyout to the throttle motor 19 for driving the throttle motor 19 with respect to the close direction, thereby maintaining the throttle valve 12 in the full close position.

Figure 3:
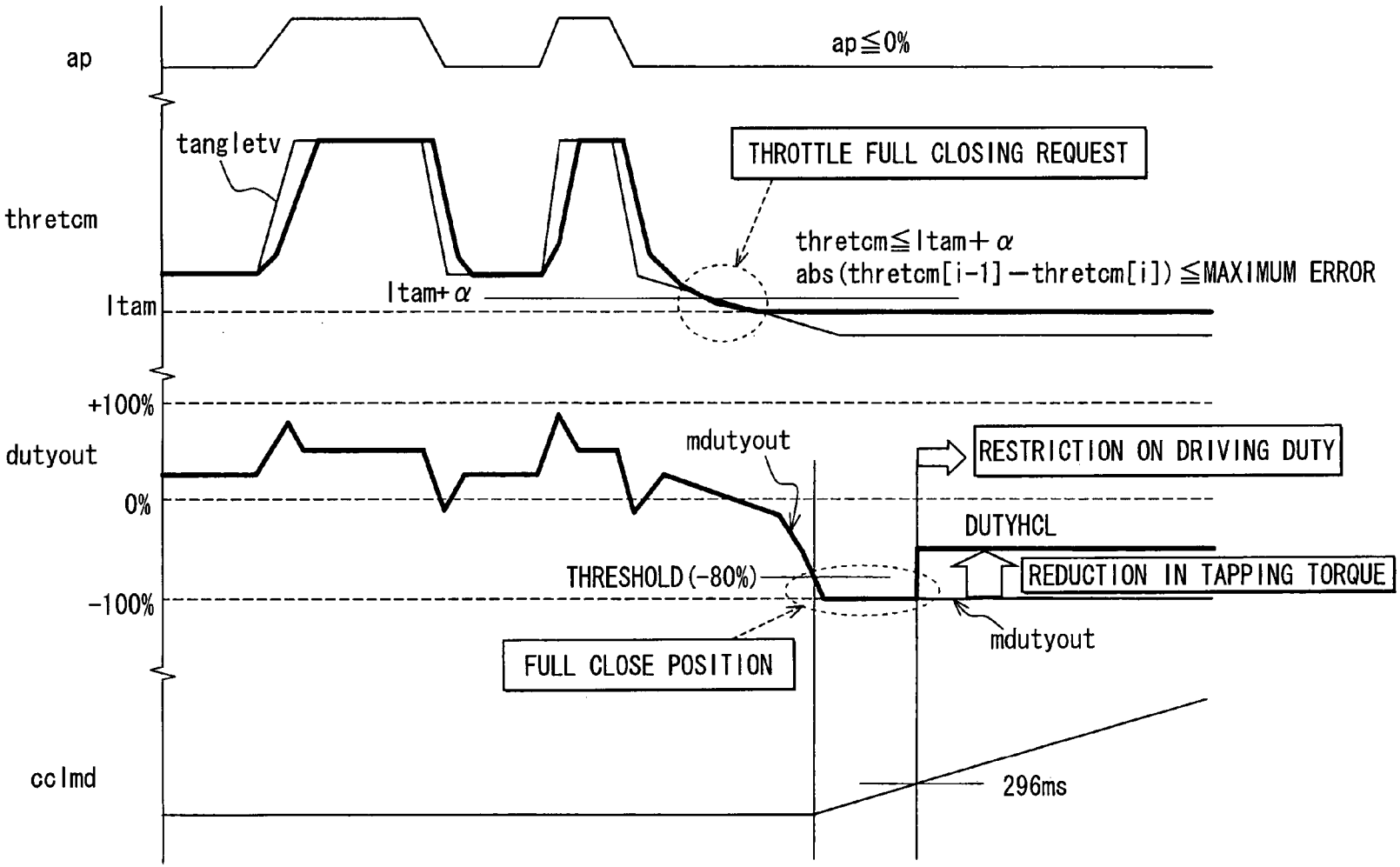
FIG. 3 is a time chart showing a control operation of the throttle motor, according to the embodiment.

As shown by the time chart depicted in FIG. 3, an idle speed control (ISC) device, or the like outputs a request signal (throttle full closing request) for operating the throttle valve 12 to be in the full close position.

Specifically, when the conditions in the above steps 102, 103 are satisfied, this throttle full closing request is output. More specifically, the condition of step 102 is satisfied when the throttle ECU 24 determines that the actual throttle opening thretcm is in the vicinity of the full close position in the case where the actual throttle opening thretcm is equal to or less than the summation of the full close learning value Itam and the predetermined value $\alpha$. In addition, the condition of step 103 is satisfied when the throttle ECU 24 determines the actual throttle opening thretcm to be substantially constant in the case where the absolute value between the previous detection value thretcm[i−1] and the present detection value thretcm[i] is equal to or less than the maximum detection error.

When the throttle full closing request is output, the throttle ECU 24 evaluates whether the throttle valve 12 is maintained in the full close position, in which the tapping operation of the throttle valve 12 is completed, at the timing, where the absolute value of the required driving duty mdutyout of the throttle motor 19 becomes greater than the threshold such as 80%.

The execution counter cclmd represents the duration of this condition, in which the throttle valve 12 is maintained in the full close position. When the execution counter cclmd increases and becomes the predetermined time such as 296 ms, which is set within the 100% duty maximum allowable period, the throttle ECU 24 restricts the actual driving duty dutyout of the throttle motor 19 with respect to the closing side to be equal to or less than the driving duty limiting value DUTYHCL. That is, the throttle ECU 24 restricts the required driving duty mdutyout within the range, in which the throttle motor 19 may not cause a failure such as burnout of the winding. Thus, the throttle ECU 24 maintains the throttle valve 12 in the full close position in a condition where the throttle ECU 24 reduces the tapping torque of the throttle motor 19.

In this operation and structure, the throttle ECU 24 is capable of maintaining the throttle valve 12 in the full close position, while limiting electricity flowing through the winding of the throttle motor 19 within the range, in which the throttle motor 19 may not cause a failure, after the throttle valve 12 reaches at the full close position. Thus, the minimum controllable amount of intake air using the throttle valve 12 can be reduced, compared with that of a conventional operation and structure. Therefore, the idling speed can be reduced, and controllability of the throttle valve 12 in the vicinity of the full close position can be enhanced in a low rotation speed range.

Summarizing the above embodiment, the electric throttle control apparatus for the internal combustion engine 27 includes the throttle valve 12, the throttle motor 19, and the throttle control unit 24. The throttle motor 19 operates the throttle valve 12. The throttle control unit 24 controls driving duty for operating the throttle motor 19 such that the actual opening degree of the throttle valve 12 coincides with the target opening degree of the throttle valve 12. The target opening degree is set in accordance with an accelerator position ap. The throttle control unit 24 is adapted for performing the tapping operation to learn the full close position of the throttle valve 12. The throttle control unit 24 determines that the tapping operation of the throttle valve 12 is completed when the throttle control unit 24 determines at least one of the following completing conditions to be satisfied. First, the accelerator position ap is at a substantially minimum position. Second, the opening degree of the throttle valve 12 is substantially constant in the vicinity of the full close position of the throttle valve 12. Third, the driving duty for operating the throttle motor 19 with respect to the close direction of the throttle valve 12 becomes equal to or greater than the threshold. The throttle control unit 24 restricts the driving duty with respect to the close direction to be equal to or less than the driving duty limiting value, thereby maintaining the throttle valve 12 in the full close position, when the throttle control unit 24 determines the completing condition to be satisfied.

In the above operation and structure, the driving duty limiting value DUTYHCL of the throttle motor 19 with respect to the close direction may be a predetermined constant value. However, when the voltage (power source voltage) of the power source, such as battery voltage vb decreases, the amount of electricity flowing through the winding of the throttle motor 19 may decrease, even when the driving duty is constant. In this condition, torque generated using the throttle motor 16 may decrease. In consideration of this characteristic, as shown in FIG. 4, the driving duty limiting value DUTYHCL may be defined in accordance with the power source voltage applied to the throttle motor 19. In this table depicted in FIG. 4, the absolute value of the driving duty limiting value DUTYHCL is preferably set greater, as the power source voltage decreases. The restriction of the driving duty may be terminated in a region, in which the power source voltage is equal to or less than a predetermined voltage such as 6V. When the driving duty limiting value DUTYHCL is variably set in accordance with the table shown in FIG. 4, for example, torque for rotating the throttle motor 19 in the close direction can be restricted from becoming insufficient, even when the power source voltage of the throttle motor 19 decreases. Thus, the power source voltage can be restricted from exerting effect to the throttle control, so that the throttle control can be steadily performed.

The driving duty dutyout may be limited to be less than the predetermined driving duty limiting value DUTYHCL, immediately after the condition where it is determined that the tapping operation of the throttle valve 12 is completed. Alternatively, as described in this embodiment, the driving duty dutyout may be limited to be equal to or less than the driving duty limiting value DUTYLRN in the learning operation when the predetermined time, which is set within the 100% duty maximum allowable period, elapses after determining that the tapping operation of the throttle valve 12 is completed. In this operation, the 100% duty may be continuously applied to the throttle motor 19 for the duration within the 100% duty maximum allowable period, in which the throttle motor 19 may not cause a failure, even after the condition, in which it is determined that the tapping operation is completed. Thus, the throttle valve 12 can be further steadily maintained in the full close position.

Furthermore, the driving duty limiting value DUTYLRN in the learning operation is set with respect to the close direction such that the throttle system can be protected from causing failure even in the learning operation of the full close position. This driving duty limiting value DUTYLRN in the learning operation may be set at a value, which is substantially the same as the driving duty limiting value DUTYHCL, which is used for evaluating whether the tapping operation is completed. Alternatively, the driving duty limiting value DUTYLRN in the learning operation may be set separately from the driving duty limiting value DUTYHCL, which is used for evaluating whether the tapping operation is completed.

In this operation, the driving duty limiting value DUTYHCL, which is used for evaluating whether the tapping operation is completed, may be set to be less than the driving duty limiting value DUTYLRN in the learning operation. Thus, even when the duration, in which the throttle valve 12 is maintained in the full close position, becomes long, the throttle system can be further steadily restricted from causing a failure.

Alternatively, the driving duty limiting value DUTYHCL, which is used for evaluating whether the tapping operation is completed, may be set to be greater than the driving duty limiting value DUTYLRN in the learning operation. In general, the learning operation of the full close position is performed immediately after turning the ignition switch ON, before starting the engine. In the throttle full closing request, the engine 27 is operated, so that intake pressure is applied to the throttle valve 12. Accordingly, the driving force of the throttle valve needs to be increased. Therefore, the driving duty limiting value DUTYHCL, which is used for evaluating whether the tapping operation is completed, is set to be greater than the driving duty limiting value DUTYLRN in the learning operation, so that the throttle valve 12 can be maintained in the full close position against the intake pressure while the engine is operated.

In the above operations and structures, the driving duty limiting value DUTYHCL, which is used for evaluating whether the tapping operation is completed, may be changed in accordance with at least one of the amount of intake air, the intake pressure, temperature of the engine, rotation speed of the engine. Furthermore, the driving duty limiting value DUTYHCL, which is used for evaluating whether the tapping operation is completed, may be changed in accordance with at least one of the duration, in which the throttle valve 12 is maintained in the full close position, and temperature of the throttle motor 19.

The mechanical structure of the electronic throttle system may be modified, as appropriate. The above embodiment may be variously modified.

The throttle motor control routine may be executed using any control unit other than the throttle ECU 24, or may be executed using any control unit other than the throttle ECU 24 together with the throttle ECU 24.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. An electric throttle control apparatus for an internal combustion engine, the throttle control apparatus comprising:

a throttle valve;

a throttle motor that operates the throttle valve; and a throttle control unit that controls driving duty for operating the throttle motor such that an actual opening degree of the throttle valve coincides with a target opening degree of the throttle valve, the target opening degree being set in accordance with an accelerator position, wherein the throttle control unit is adapted for performing a tapping operation to learn a full close position of the throttle valve, the throttle control unit determines that the tapping operation of the throttle valve is completed when the throttle control unit determines the following completing conditions to be satisfied:

the accelerator position is at a substantially minimum position;

the opening degree of the throttle valve is substantially constant in the vicinity of the full close position of the throttle valve; and the driving duty for operating the throttle motor with respect to a close direction of the throttle valve becomes equal to or greater than a threshold, wherein the throttle control unit restricts the driving duty with respect to the close direction to be equal to or less than a driving duty limiting value, thereby maintaining the throttle valve in the full close position, when the throttle control unit determines the completing condition to be satisfied.

2. The throttle control apparatus according to claim 1, wherein the throttle control unit restricts the driving duty with respect to the close direction to be equal to or less than the driving duty limiting value when a predetermined time elapses after the throttle control unit determines the completing condition to be satisfied, and the predetermined time is set within a maximum allowable period, in which 100% of the driving duty can be continuously applied to the throttle motor.

3. The throttle control apparatus according to claim 1, wherein the throttle control unit sets the driving duty limiting value in accordance with voltage of a power source of the throttle motor.

4. The throttle control apparatus according to claim 1, wherein the driving duty limiting value includes a first duty limiting value and a second duty limiting value, the throttle control unit individually sets the first duty limiting value and the second duty limiting value, the first duty limiting value is used in the tapping operation, in which the throttle control unit learns the full close position by tapping the throttle valve at the full close position, and the second duty limiting value is used after the tapping operation of the throttle valve is determined to be completed.

5. The throttle control apparatus according to claim 4, wherein the throttle control unit sets the second duty limiting value to be greater than the first duty limiting value.

6. The throttle control apparatus according to claim 4, wherein the throttle control unit sets the second duty limiting value to be less than the first duty limiting value.

7. The throttle control apparatus according to claim 1, wherein the actual opening degree of the throttle valve becomes substantially minimum in the full close position.

8. A method for controlling driving duty applied to a throttle motor operated using a throttle motor, the method comprising:

performing a tapping operation to learn a full close position of the throttle valve, determining the tapping operation to be completed when the following completing conditions are satisfied:

an accelerator position is at a substantially minimum position;

an opening degree of the throttle valve is substantially constant in the vicinity of the full close position of the throttle valve; and the driving duty for operating the throttle motor with respect to a close direction of the throttle valve becomes equal to or greater than a threshold, the method further comprising:

maintaining the throttle valve in the full close position by restricting the driving duty to be equal to or less than a driving duty limiting value, when the completing condition is satisfied.

9. The method according to claim 8, further comprising:

setting a predetermined time within a maximum allowable period, in which 100% of the driving duty can be continuously applied to the throttle motor; and restricting the driving duty with respect to the close direction to be equal to or less than the driving duty limiting value when the predetermined time elapses after the completing condition is satisfied.

10. The method according to claim 8, further comprising:

setting the driving duty limiting value in accordance with voltage of a power source of the throttle motor.

11. The method according to claim 8, further comprising:

setting a first duty limiting value of the driving duty limiting value and a second duty limiting value of the driving duty limiting value individually from each other;

maintaining the throttle valve in the full close position by restricting the driving duty with respect to the close direction to be equal to or less than the first duty limiting value in the tapping operation, in which the throttle control unit learns the full close position by tapping the throttle valve at the full close position; and maintaining the throttle valve in the full close position by restricting the driving duty with respect to the close direction to be equal to or less than the second duty limiting value after the tapping operation.

12. The method according to claim 11, wherein the second duty limiting value is greater than the first duty limiting value.

13. The method according to claim 11, wherein the second duty limiting value is less than the first duty limiting value.

14. The method according to claim 8, further comprising:

setting a target opening degree in accordance with an accelerator position; and controlling driving duty for operating the throttle motor such that an actual opening degree of the throttle valve coincides with the target opening degree of the throttle valve.

15. The method according to claim 8, wherein the actual opening degree of the throttle valve is substantially minimum in the full close position.

* * * * *